US008967606B2

(12) United States Patent
Hamm et al.

(10) Patent No.: US 8,967,606 B2
(45) Date of Patent: Mar. 3, 2015

(54) PIPE VISE STAND

(75) Inventors: James E. Hamm, Grafton, OH (US); Christopher R. Miller, Swanton, OH (US); Robert Skrjanc, Lorain, OH (US)

(73) Assignee: Emerson Electric Co., St. Louis, MO (US)

( * ) Notice: Subject to any disclaimer, the term of this patent is extended or adjusted under 35 U.S.C. 154(b) by 1087 days.

(21) Appl. No.: 13/005,032

(22) Filed: Jan. 12, 2011

(65) Prior Publication Data

US 2012/0174649 A1 Jul. 12, 2012

(51) Int. Cl.

| | |
|---|---|
| ***B21D 9/12*** | (2006.01) |
| ***B25H 1/06*** | (2006.01) |
| ***B25H 1/08*** | (2006.01) |
| ***B25H 1/10*** | (2006.01) |
| ***B25H 1/16*** | (2006.01) |

(52) U.S. Cl.

CPC .. *B25H 1/06* (2013.01); *B25H 1/08* (2013.01); *B25H 1/10* (2013.01); *B25H 1/16* (2013.01)

USPC ..... 269/130

(58) Field of Classification Search

CPC ..... B21D 9/12; B21D 9/08; B21D 9/05; B21D 9/055; B21D 9/00; B21D 9/04; B21D 7/21; B21D 7/06; B21D 7/22; B21D 7/00; B21D 11/02; B21D 11/22; B25B 1/20; B25B 1/205

USPC ..... 269/3, 4, 296

See application file for complete search history.

(56) References Cited

U.S. PATENT DOCUMENTS

| | | | | |
|---|---|---|---|---|
| 798,371 | A | 8/1905 | Ward | |
| 1,040,603 | A * | 10/1912 | Amborn | 269/130 |
| 1,054,661 | A | 3/1913 | Amborn | |
| 1,126,544 | A * | 1/1915 | Martin | 72/322 |
| 1,158,414 | A | 10/1915 | Amborn | |
| 1,184,991 | A | 5/1916 | Pettit | |
| 1,216,610 | A | 2/1917 | Rosenbaum | |
| 1,393,766 | A | 10/1921 | Charme | |
| 1,634,837 | A | 7/1927 | Lee | |
| 1,653,326 | A | 12/1927 | Welter | |
| 1,686,023 | A * | 10/1928 | McCloskey | 269/129 |
| 1,695,311 | A | 12/1928 | Young | |
| 1,726,898 | A * | 9/1929 | Jones | 72/460 |
| 1,784,264 | A * | 12/1930 | Young | 248/168 |
| 1,785,884 | A * | 12/1930 | Vosper | 269/130 |
| 1,798,340 | A * | 3/1931 | Thewes | 72/460 |
| 1,812,967 | A * | 7/1931 | Long | 248/168 |
| 1,897,449 | A | 2/1933 | Trowbridge | |
| 2,191,191 | A | 2/1940 | Pealer | |
| D121,898 | S * | 8/1940 | Ingwer | D8/74 |

(Continued)

OTHER PUBLICATIONS

The Ridge Tool Company, "Price List", Dec. 1, 1939, 13 pages.

(Continued)

*Primary Examiner* — Lee D Wilson
*Assistant Examiner* — Jamal Daniel
(74) *Attorney, Agent, or Firm* — Mark E. Bandy; Rankin, Hill & Clark LLP

(57) ABSTRACT

A pipe vise stand having increased utility and greater useable work space, particularly during use of vise provisions associated with the stand, is described. The stand features a base plate having a unique configuration in which one or more pipe benders are located within a workpiece support region defined along an upwardly directed face of the plate between vise provisions and corresponding support provisions.

21 Claims, 11 Drawing Sheets

(56) References Cited

U.S. PATENT DOCUMENTS

| | | | | | |
|---|---|---|---|---|---|
| 2,297,980 | A | | 10/1942 | Perkins | |
| 2,310,255 | A | * | 2/1943 | O'Connell | 269/98 |
| 2,666,609 | A | | 1/1954 | Ingwer | |
| 2,678,790 | A | * | 5/1954 | Egger | 248/168 |
| 2,703,027 | A | * | 3/1955 | Petersen | 269/130 |
| D175,105 | S | | 7/1955 | Ewing et al. | |
| 2,733,330 | A | | 1/1956 | Blewett | |
| 2,831,583 | A | * | 4/1958 | Wright et al. | 108/173 |
| 2,883,184 | A | * | 4/1959 | Brewington | 269/9 |
| 2,978,114 | A | | 4/1961 | Halligan | |
| 3,656,439 | A | | 4/1972 | Domin | |
| 4,083,624 | A | | 4/1978 | Timmer | |
| 4,133,519 | A | | 1/1979 | Shin et al. | |
| 4,210,373 | A | | 7/1980 | McGee | |
| 4,231,557 | A | | 11/1980 | Blachly et al. | |
| 4,349,931 | A | * | 9/1982 | Leon | 470/207 |
| 4,715,760 | A | | 12/1987 | Browning | |
| 5,135,208 | A | * | 8/1992 | Diskin | 269/130 |
| 6,073,919 | A | * | 6/2000 | Hammit et al. | 269/17 |
| 6,089,554 | A | * | 7/2000 | Berardino | 269/130 |
| 6,471,220 | B1 | | 10/2002 | Babb | |
| 7,430,968 | B2 | | 10/2008 | Clark | |
| 7,537,186 | B2 | * | 5/2009 | Putre et al. | 248/169 |
| 7,992,852 | B2 | * | 8/2011 | Marineau et al. | 269/89 |
| D645,319 | S | * | 9/2011 | Hamm et al. | D8/70 |
| D645,320 | S | * | 9/2011 | Hamm et al. | D8/70 |
| D645,321 | S | * | 9/2011 | Hamm et al. | D8/70 |
| D645,322 | S | * | 9/2011 | Hamm et al. | D8/70 |
| D645,323 | S | * | 9/2011 | Hamm et al. | D8/70 |
| D645,324 | S | * | 9/2011 | Hamm et al. | D8/70 |
| D645,325 | S | * | 9/2011 | Hamm et al. | D8/70 |
| D645,326 | S | * | 9/2011 | Hamm et al. | D8/70 |
| D645,327 | S | * | 9/2011 | Gress | D8/70 |
| 8,601,855 | B1 | * | 12/2013 | Hamm et al. | 72/389.1 |
| 2007/0080268 | A1 | | 4/2007 | Worrell | |
| 2008/0029662 | A1 | | 2/2008 | O'Rourke | |
| 2009/0194923 | A1 | * | 8/2009 | Marineau et al. | 269/89 |
| 2012/0175833 | A1 | * | 7/2012 | Hamm et al. | 269/266 |
| 2012/0175834 | A1 | * | 7/2012 | Hamm et al. | 269/293 |

OTHER PUBLICATIONS

The Ridge Tool Company, "Genuine RIDGID Work-Saver Pipe Tools", Catalog, Aug. 7, 1961, pp. 1-28.

Emerson Professional Tools, "Portable TRISTAND Vises", website http://www.ridgid.com/Tools/Portable-Tristand-Vises, Feb. 9, 2010, 1 page.

Ridge Tool Company, "RIDGID Tristand Chain Vise", Catalog p. 999-998-422.10, Aug. 2004, 1 page.

Ridge Tool Company, "RIDGID Adjusting Tri-Stand Leg Stiffness", Catalog p. 999-998-461.10, Jul. 1998, 1 page.

Ridge Tool Company, "RIDGID Assembling Tri-Stand Legs and Tray", Catalog page, 1 page.

Berkley Tool Pipemaster, Catalog, 24 pages.

Steel Dragon Tools, "SDT 460 1/8"-6" Tri Stand Chain Vise fits Ridgid 72037", website http://www.steeldragontools.com/item-detail.php?pid=70, Feb. 9, 2010, 6 pages.

Steel Dragon Tools, "BC-610 Portable Bench Pipe Chain Vise SDT 40210", website http://www.steeldragontools.com/item-detail.php?pid=64, Feb. 9, 2010, 3 pages.

Reed Pipe Tools & Vises, "Tripods—R450+, R470+, R40+", website http://www.reedmfgco.com/index.html?screen=tripods_r450_r470_r40, Feb. 9, 2010, 1 page.

Reed Pipe Tools & Vises, "Chain Vises", website http://www.reedmfgco.com/index.html?screen=chain_vises, Feb. 9, 2010, 1 page.

Maxpower Tools for Industry, "Max-Stand Chain Vise", website http://www.worldclasstoolsource.com/chain-vise.htm, Feb. 9, 2010, 1 page.

Silom, "Products : Vices & Workbench", website http://www.silom.co.uk/php/products.php?categoryid=1340, Feb. 9, 2010, 3 pages.

Rothenberger, "Vises & Pipe Stands", website http://www.rothenbergertools.us/471.html, Feb. 9, 2010, 2 pages.

Wheeler-Rex, "Pipe Working Tools", Catalog, Jan. 1, 2009, pp. 40-41.

* cited by examiner

PIPE VISE STAND

FIELD OF THE INVENTION

The present invention relates to a pipe vise stand having increased utility and useable work area.

BACKGROUND OF THE INVENTION

Vise stands are well known in the art. Vise stands have been used in various forms for well over 100 years. Typically, vise stands include a plate or similar relatively flat member supported by a collection of legs, usually foldable or hinged in some manner to enable the stand to be placed into a compact form and more readily transported to and from a work or job site. Vise stands also include a vise or similar mechanism for selectively engaging a workpiece to thereby enable an operator to perform one or more operations associated with the workpiece. Typically, the vise is in the form of a chain vise, however an array of other types of vises have been utilized.

Several types of vise stands are known, each of which has evolved to meet the needs of certain categories of workpieces and/or operations involving the workpieces. For example, relatively simple vertical stands are known which elevate and support a vise. Multi-leg stands with spaceable planar members similar to "horses" are known for supporting long metal or wood stock.

A particular type of vise stand for pipes has also evolved. Pipe vise stands typically include a chain vise as opposed to a moving jaw type vise since chain vises can provide engagement around the outer circumference of a pipe and thereby more securely retain the pipe. The chain vise or other vise provisions are typically incorporated into the plate member of the stand.

Another feature that is commonly found in pipe vise stands is a tube bender. A tube or pipe bender as typically provided in pipe vise stands includes one or more outwardly projecting members that define a pipe bending mandrel surface. These members typically are incorporated into the plate member and extend upward from the plate. The mandrel surfaces are typically concave and sized to receive one of various common tube or pipe diameters. The mandrel surfaces typically extend approximately 90° in an arcuate fashion about a generally horizontal bending axis to provide an arcuate forming surface about which a tube or pipe can be bent. For pipes of sufficiently small diameters and/or having walls that are sufficiently thin, an operator can manually bend pipe or tubing to a desired extent at a job site by use of a tube bender provided in a pipe vise stand.

Modern pipe vise stands may also include other provisions which may be useful to a pipe fitter, welder, or plumber. For example, in addition to a chain vise, one or more support members oppositely located from the chain vise are typically provided. The support members are typically incorporated into the plate and project upward from the plate. These support members assist in supporting and retaining a pipe engaged in the vise. Another feature sometimes provided in pipe vise stands is a holder for hand tools typically used by an operator. Holders may be in the form of hooks or other projections along the plate or work surface of the stand, or in the form of recesses or apertures in the plate, from which tools can be hung.

Many pipe vise stands also include provisions for improving the stability of the stand. These provisions may be in the form of tie-downs or other fixtures along the plate for attaching cables or rigid members to, which are then attached to mounting points along the floor or nearby walls. Another type of stabilizing provision is a jackscrew. Many pipe vise stands include a jackscrew assembly extending from the plate. The jackscrew is oriented to engage a stationary rigid member extending overhead. Upon extension of the jackscrew against the rigid member, a downwardly directed load or force is applied to the plate and legs of the vise stand, which can significantly improve the stability of the stand.

As a consequence of including one or more of the previously noted provisions in a pipe vise stand, the useable work area along an upper face of the plate is significantly reduced. As a result, plate members must be increased in size in order to provide a work area of sufficient size. However, increasing the size of plate members results in a larger and heavier vise stand. Furthermore, increasing the size of plate members may also increase the size and weight of other components of the stand such as the legs. Increased sizes and weights of vise stands increase costs of the resulting stands and reduces the ease and portability of the stands, which as will be appreciated is undesirable.

Accordingly, a need exists for an improved pipe vise stand which includes an array of provisions typically associated with currently available stands, yet which also provides an increased work area while not being excessively heavy or difficult to transport.

SUMMARY OF THE INVENTION

The difficulties and drawbacks associated with previously known vise stands are addressed in the various pipe vise stands and base plates described herein.

In one aspect, the present invention provides a pipe vise stand comprising a base plate defining a work face and including at least one support provision extending from the work face and vise provisions spaced from the at least one support provision. The base plate further defines a workpiece support territory along the work face and extending between the at least one support provision and the vise provisions. The pipe vise stand also comprises a plurality of legs attached to the base plate. The base plate further includes at least one tube bender disposed at least partially within the workpiece support territory.

In another aspect, the present invention provides a pipe vise stand comprising a base plate, and a plurality of extendable legs movably attached to the base plate. Each leg defines a proximal end attached to the base plate and a distal end opposite from the proximal end. The vise stand is positionable between (i) a work configuration in which the plurality of legs are extended from the base plate to an extended position and the distal ends of the legs generally reside within a common plane, and (ii) a transport configuration in which the legs are retracted from their extended position. The base plate defines a work face, the work face being upwardly directed when the vise stand is in a work configuration and the distal ends of the legs are contacting a horizontal surface. The base plate includes vise provisions at a first location along the base plate, support provisions at a second location along the base plate generally opposite and spaced from the vise provisions, and at least one bending mandrel extending from the base plate. The base plate defines a workpiece support territory along the work face of the base plate extending between the vise provisions and the support provisions. And, the at least one bending mandrel is at least partially located within the workpiece support territory.

In yet another aspect, the present invention provides a base plate for use with a pipe vise stand. The base plate defines a work face, an oppositely directed underside, and a peripheral edge region generally extending between the work face and the underside. The base plate comprises at least one support provision extending from the base plate beyond the work face. The at least one support provision defines a first width dimension. The base plate also comprises vise provisions extending from the base plate. The vise provisions define a second width dimension. The vise provisions are spaced from the at least one support provision. The base plate further defines a workpiece support territory along the work face extending between the first width dimension associated with the at least one support provision and the second width dimension associated with the vise provisions. The base plate further comprises a tube bender disposed within the work piece support territory.

As will be realized, the invention is capable of other and different embodiments and its several details are capable of modifications in various respects, all without departing from the invention. Accordingly, the drawings and description are to be regarded as illustrative and not restrictive.

DETAILED DESCRIPTION OF THE EMBODIMENTS

The preferred embodiment pipe vise stands of the present invention include a base plate having a unique configuration. The base plate generally defines an upwardly directed work face and an oppositely directed underside. A plurality of legs, preferably three, are movably attached to the base plate and preferably along the underside of the base plate. The plurality of legs can be extended from a retracted position such that upon extension of the legs and contact between the leg distal ends and the floor, the base plate is elevated above the floor and oriented to provide a relatively level and horizontal work surface. In addition, the pipe vise stands preferably include locking provisions for ensuring that the legs remain in their extended position until an operator takes affirmative action to retract the legs. A chain 1 or other flexible member is preferably attached to one of the legs 40. Upon positioning the legs to a retracted position preferably attached to one of the legs 40.

Various references to "up", "upward", "underside" and the like are made herein. These orientation references are made with regard to the stand in a typical configuration during use, e.g. the stand having its legs fully extended and the stand positioned upright upon a floor.

The preferred embodiment pipe vise stands feature a base plate having a particular configuration as follows. The base plate includes vise provisions preferably located along a peripheral region of the base plate. Although a wide array of vise types may be used, preferably the vise is a chain vise as known in the art. The base plate also preferably includes one or more workpiece support members extending from the work face and located generally opposite the vise provisions and preferably also along a peripheral region of the base plate. The support members may separately or collectively define an upwardly directed V-shaped region for supporting a workpiece such as a pipe, and particularly a pipe engaged by the noted vise provisions.

Figure 2:
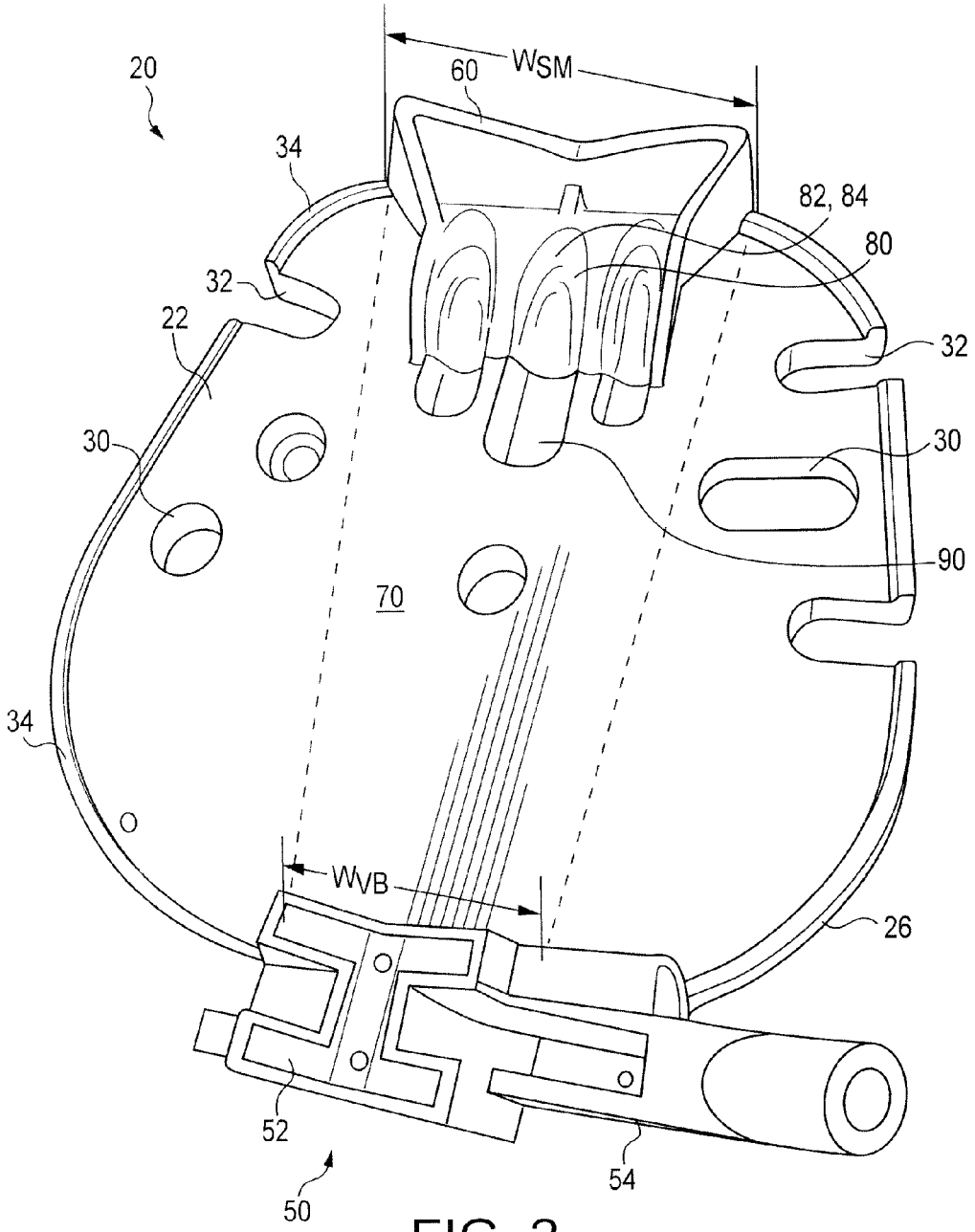
FIG. 2 is a generally planar view of a preferred base plate used in the preferred embodiment pipe vise stand of the invention.

The upwardly directed work face of the base plate defines a workpiece support territory generally extending between the vise provisions and the workpiece support provisions. The workpiece support territory extends between these provisions and has a width generally corresponding to the width of these provisions. Thus, at a region of the base plate at which is located the vise provisions, the width of the workpiece support territory is generally equal to that of the vise provisions. This width is referred to herein as $W_{VB}$ and is illustrated in FIG. 2. The width $W_{VB}$ generally taken along the interface between the upwardly directed work face of the base plate and the vise provisions which generally project upwardly therefrom. And, at a region of the base plate at which is located the support provisions, the width of the workpiece support territory is generally equal to that of the support provisions. This width is referred to herein as $W_{SM}$ and is illustrated in FIG. 2.

The width $W_{SM}$ is generally taken along the interface between the upwardly directed work face of the base plate and the support provisions which generally extend upwardly therefrom. The widths of the workpiece support territory at its two ends can be different or the same. Additional details and aspects of the workpiece support territory are provided herein.

As previously noted, it is known to provide one or more pipe or tube benders in a pipe vise stand, and particularly in a base plate of such stands. A typical pipe or tube bender generally includes a bending mandrel and a corresponding workpiece aperture located proximate to the bending mandrel. Upon placing the pipe against the mandrel, a region of the pipe extends through the aperture. The pipe is initially oriented in a generally vertical position while the pipe extends through the bending aperture. Since the aperture is only slightly larger than the outer diameter of the pipe, upon urging the pipe against the bending mandrel, the region of the pipe within the aperture contacts the base plate, and is held stationary. This facilitates bending of the pipe along the arcuate surface of the bending mandrel as an operator applies force to a region of the pipe generally above the mandrel. Bending mandrels are typically in the form of a bending member extending upward from the work face of a base plate. The bending member defines a recessed concave region extending about a bending arc that is preferably defined about a horizontal axis. The recessed concave region is sized and shaped to fittingly receive a pipe and preferably a standard size pipe. The exposed surface of this concave region is the forming or bending surface. The workpiece aperture is sized to accept and receive the pipe of interest. Typically, bending mandrels are provided in groups or multiple sets so that the mandrels can be used to bend a range of pipe diameters, such as for example, ⅜ inch, ½ inch, ⅝ inch, ¾ inch, and 1 inch pipe. A typical combination of pipe diameters which bending mandrels accommodate is ½ inch, ¾ inch, and 1 inch. Collections of pipe or tube bending provisions are typically referred to in the art as "tube benders." This term is periodically used herein. Representative examples of tube benders include those noted in U.S. Pat. Nos. 1,126,544; 1,393,766; and 2,831,583, for example.

The unique base plates of the preferred embodiment pipe vise stands, utilize a configuration in which at least a portion of a tube bender or collection of tube benders is located within the workpiece support territory defined along the work face of the base plate. Preferably, the tube bender or collection of benders is located entirely within the workpiece support territory defined by the base plate. These particular configurations have been discovered to significantly increase the useable work area associated with the base plate, particularly while a workpiece such as a pipe is engaged by the vise provisions and supported by the workpiece support provisions. Thus, by use and/or adoption of these particular configurations, a base plate can provide a relatively large useable work area while also providing an array of features, without an increase in the overall size of the base plate. In addition, another significant advantage of locating the tube bender(s) within a central region of the base plate is that greater loads or forces can be applied to a workpiece or pipe engaged therewith out impacting the stability of the stand, which facilitates bending.

Another feature of the preferred embodiment pipe vise stands described herein is the use of tube benders that do not exceed a particular height as compared to aspects of the vise provisions and the workpiece support provisions. That is, the tube bender(s) have a maximum height and are disposed at particular locations within the workpiece support territory such that they do not interfere and thus do not contact a pipe when supported and engaged by the workpiece support and vise provisions. These aspects are described in greater detail herein in association with the preferred embodiment pipe vise stands.

Figure 1:
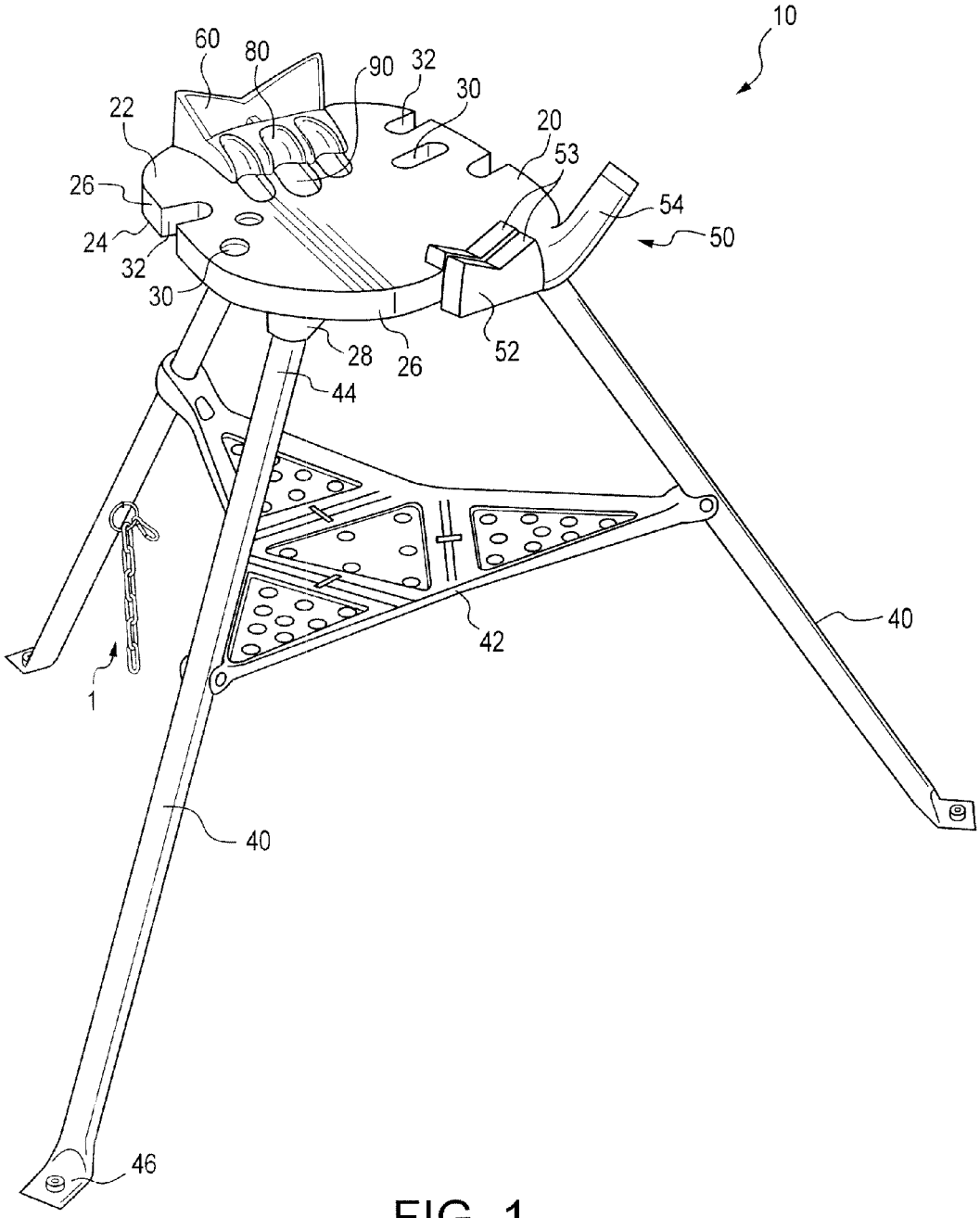
FIG. 1 is a perspective view of a preferred embodiment pipe vise stand in accordance with the present invention.

FIG. 1 illustrates a preferred embodiment pipe vise stand 10 in accordance with the present invention. The stand 10 comprises a base plate 20 defining a generally upwardly directed work face 22, an oppositely directed underside 24, and a peripheral edge 26 extending between the faces 22 and 24. The base preferably includes one or more leg receptacles 28 generally along the underside 24 of the base plate 20. The base plate 20 may further define one or more apertures 30 extending at least partially through the plate 20. One or more edge slots 32 are also preferably defined about the outer region or edge 26 of the base plate 20. The base plate 20 can also include an upwardly extending lip extending at least partially around the outer perimeter of the base plate 20.

The preferred embodiment pipe vise stand 10 also comprises a plurality of legs 40 movably affixed to the base plate 20 and preferably extending from the underside of the base plate 20. Each leg 40 defines a proximal end 44 and an opposite distal end 46. The proximal end 44 is preferably engaged with a corresponding leg receptacle 28 provided along the underside 24 of the base plate 20. As noted, the plurality of legs 40 are preferably positionable between an extended position such as shown in FIG. 1, and a retracted position, such as when transporting the pipe vise stand 10. The stand 10 also preferably includes an extension support frame 42 that is movably affixed to an intermediate region of each of the legs 40. Upon extension of the legs 40 to the position depicted in FIG. 1, the support frame 42 serves to ensure that the legs 40 remain in this extended position until an operator takes affirmative steps to reposition the legs 40 to a retracted position. The present invention includes pipe vise stands having nearly any number of legs. As previously noted, three legs are preferred. However, pipe vise stands having four legs are also included. Moreover, if suitably rendered stable, it is contemplated that a pipe vise stand as described herein could be provided with two legs or a single leg. A chain 1 or other flexible member is preferably attached to one of the legs 40. Upon positioning the legs to a retracted position, the chain 1 or member can be wrapped about the legs.

The pipe vise stand 10 further comprises vise provisions 50 which are preferably formed or otherwise engaged to the base plate 20. The vise provisions include a vise base 52 that defines an upwardly directed workpiece engaging face 53, and a handle base 54 for receiving a handle (not shown). The vise provisions 50 are most preferably provided in the form of a chain vise and so include a chain (not shown). Details as to chain vises suitable for incorporation in the present invention pipe vise stands and base plates are provided in association with currently known chain vises such as those available from Ridge Tool of Elyria, Ohio under the model designations BC210, BC410, BC210P, BC410P, BC510, BC610, BC810, BC2A, BC4A, and 640, for example. In addition, representative examples of features, construction, assembly, materials, and other aspects of chain vises are provided in one or more of the following U.S. Pat. Nos. 4,349,931; 1,158,414; 2,703,027; and 1,054,661. Although chain vises are preferred for incorporation or use with the pipe vise stands and/or base plates described herein, it is to be appreciated that other types of vises could be used such as, but not limited to, yoke vises.

The pipe vise stand 10 also preferably comprises one or more workpiece support member(s) 60 extending upward from the work face 22 of the base plate 20. The workpiece support members 60 are preferably located across and generally opposite from the vise provisions 50. The workpiece support member(s) 60 are preferably formed integral with the base plate 20, however the invention includes embodiments in which one or more workpiece support member(s) 60 are selectively attached or otherwise removably engaged with a stand or a base plate.

The pipe vise stand 10 also comprises one or more pipe benders 80. The pipe benders are preferably oriented so as to extend upward from the work face 22 of the base plate 20. Each pipe bender includes an upwardly extending bending mandrel or member and a recessed concave region. A corresponding workpiece aperture 90 is also preferably defined in the base plate 20 and most preferably proximate the bending mandrel. The location of the pipe benders 80 relative to other components and details of the pipe benders are described in greater detail herein.

Figure 3:
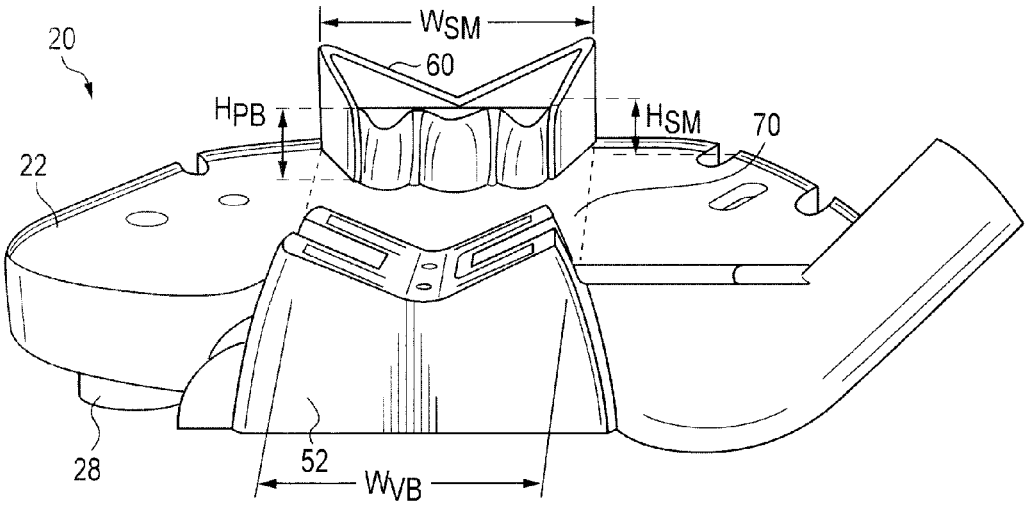
FIG. 3 is a detailed perspective view of the preferred base plate.
Figure 4:
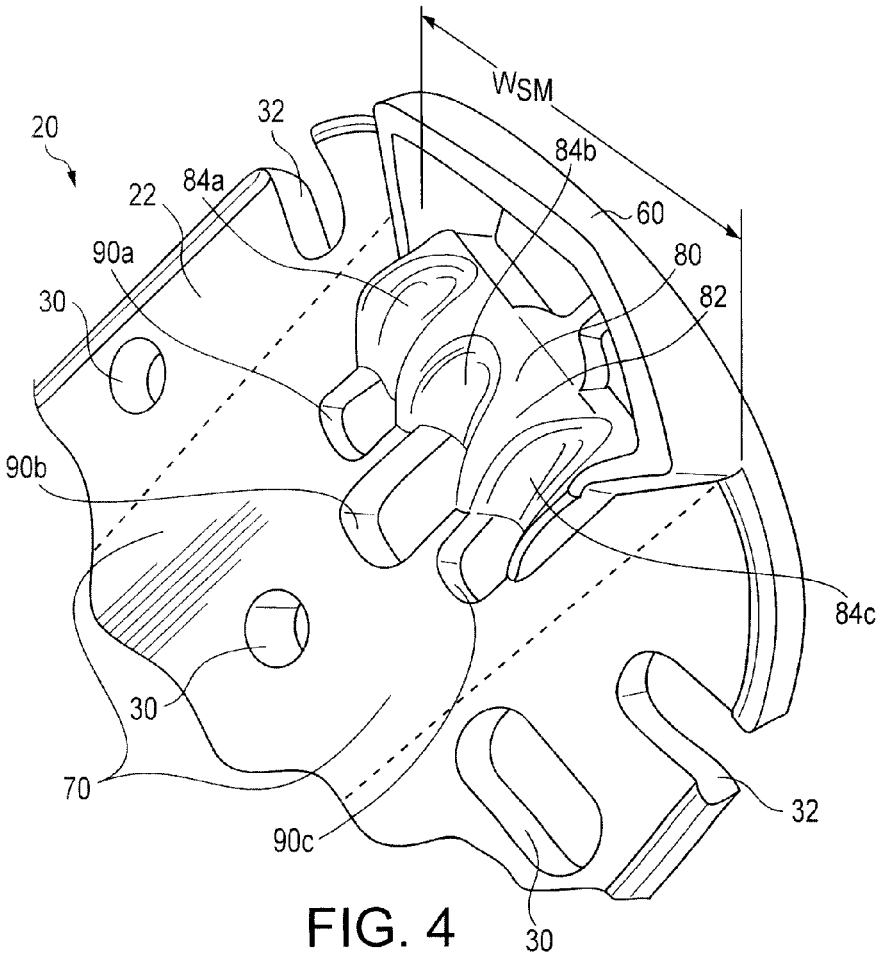
FIG. 4 is a partial detailed view of the preferred base plate.

FIGS. 2-4 illustrate a base plate 20 of the preferred embodiment pipe vise stand 10 in greater detail. Each pipe bender includes an upwardly directed bending mandrel or member 82 and a recessed concave region 84. As best depicted in FIG. 2, a workpiece aperture 90 is disposed immediately proximate to a lowermost region of the concave region 84 of the bending mandrel 82. Each mandrel 82, concave region 84, and workpiece aperture 90 is sized to closely receive and accommodate a pipe or tube of interest. More specifically, FIG. 4 illustrates a first tube bender portion of the benders 80 defining a concave region 84*a* and a corresponding workpiece aperture 90*a*. A second tube bender portion of the benders 80 defining a concave region 84*b* and a corresponding aperture 90*b* is also depicted. And, a third tube bender portion of the benders 80 defining a concave region 84*c* and a corresponding aperture 90*c* is illustrated. As will be appreciated, each of the sets of a concave region and an aperture are preferably sized to receive and accommodate a pipe or tube of interest.

The base plate 20 defines a workpiece support territory 70 extending along the work face 22 of the base plate 20. The workpiece support territory 70 extends between the vise provisions 50, and preferably the vise base 52; and the workpiece support member(s) 60. The workpiece support territory 70 is generally denoted as the region along the work face 22 extending between the dashed lines in FIGS. 2-4. Most preferably, the width of the workpiece support territory 70 along a region of the base plate 20 at which is located the vise provisions 50, is equal to the width of the vise base 52, illustrated in the referenced figures as $W_{VB}$. And, most preferably, the width of the workpiece support territory 70 along a region of the base plate 20 at which is located the workpiece support member(s) 60, is equal to the width of the workpiece support member(s) 60, illustrated in the referenced figures as $W_{SM}$. FIG. 2 illustrates the various features and provisions of the preferred plate 20 as described in conjunction with FIG. 1. FIG. 2 also illustrates a lip 34 that may optionally be provided to extend at least partially around the outer periphery of the plate 20.

Referring further to FIGS. 2-4, in accordance with the present invention, it is preferred that at least a portion and preferably all of the pipe benders 80 be located within the workpiece support territory 70. In the particular embodiment shown, the pipe benders 80 are entirely located within the workpiece support territory 70. Furthermore, the pipe benders 80 are depicted as generally centered within the territory 70 along the width dimension of the base plate 20. In addition, for certain embodiments it is also preferred that the maximum height of the pipe benders 80 is equal to or less than the minimum height of the workpiece support member(s) 60. The heights of the pipe benders 80 and the workpiece support member(s) 60 are measured from the work face 22 of the base plate 20. For the particular embodiment under discussion, FIG. 3 illustrates a maximum height of pipe benders 80 as $H_{PB}$. And, FIG. 3 also depicts a minimum height of the workpiece support member(s) 60 as $H_{SM}$. Thus, preferably the relative heights of these components are:

$$H_{SM} \geq H_{PB}$$

Preferably, the maximum height of the pipe benders 80 is equal to or less than the minimum height of the workpiece support member(s) 60. In this preferred configuration, upon positioning a workpiece or pipe on the support member(s) 60. In this preferred configuration, and the vise provisions, the upwardly extending pipe benders 80, located in the workpiece support territory, will not interfere with, e.g. contact, the workpiece.

However, it will be appreciated that the invention is not limited to this preferred configuration. Instead, the invention includes arrangements in which the maximum height of a bender or collection of benders may be greater than a minimum height of the workpiece support member(s). Generally, such an arrangement may exist when the height of a bender or collection of benders is laterally offset or spaced from the location of minimum height of the workpiece support member(s). It is also contemplated that the maximum height of the bender(s) may be greater than the minimum height of the support member(s) even for configurations in which the bender(s) are directly in front of the support member(s) as depicted in FIG. 3. Such configurations are permissible when the support member(s) is used to support a pipe or other cylindrical body. Due to the V-shaped profile of the support member(s) as depicted in FIG. 3, when a pipe is placed within the V-shaped support member, the lowermost surface of the pipe will be spaced above the minimum height of the support member. Thus, the maximum height of the bender(s) could extend within the region between the lowermost pipe surface and the minimum height of the support member. However, generally, the height of the bender(s) is less than or equal to the height of the workpiece support member(s) when these heights are taken at locations along a line parallel to a pipe or other member when supported in the support member(s).

It will be appreciated that in no way is the present invention limited to base plates having the particular configuration, shape, and/or layout as illustrated in FIGS. 2-4. Nor is the present invention limited to components or provisions as shown in the referenced figures. Thus, it is contemplated that base plates of the present invention could utilize vise base plate structures having different shapes and/or configurations than that depicted in FIGS. 2-4. Similarly, the base plates of the invention can use work support members of different shapes, styles, and configurations than the support member(s) 60 illustrated in FIGS. 2-4. Likewise, the invention includes tube benders having a wide range of shapes, styles, and configurations.

Figure 5:
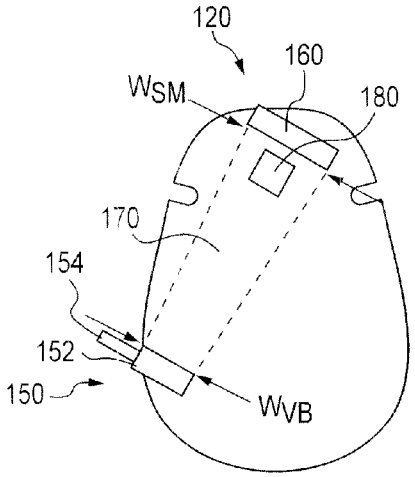
FIG. 5 is a schematic planar view of another preferred embodiment base plate in accordance with the present invention.

The present invention includes a wide array of different arrangements and configurations of the base plate and specifically, the relative locations of the vise provisions, workpiece support member(s), and the pipe benders. For example, FIGS. 5-8 are schematic planar views of additional preferred embodiment base plates in accordance with the present invention. FIG. 5 depicts a preferred embodiment base plate 120 comprising vise provisions 150 and workpiece support member(s) 160. A workpiece support territory 170 is defined between a vise base 152 of the vise provisions 150 and the workpiece support member(s) 160. One or more pipe bender(s) 180 are located within the workpiece support territory 170. It will be appreciated that in this embodiment, the vise provisions 150 are not centered along a central axis of the base plate as in the base plate 20 of FIGS. 1-4, but instead located along a corner or lateral edge region of the base plate 120. The handle base 154 can be oriented as desired and is not limited to the particular orientation shown in FIG. 5. The orientation of the workpiece support member(s) 160 may be directed so as to face the vise base 152 shown in FIG. 5.

Figure 6:
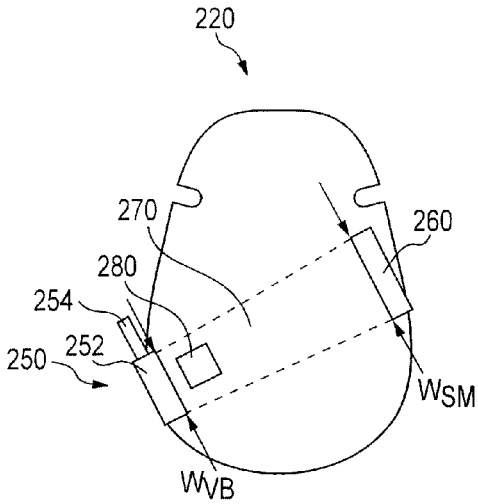
FIG. 6 is a schematic planar view of another preferred embodiment base plate in accordance with the present invention.

FIG. 6 depicts yet another preferred embodiment base plate 220 in accordance with the present invention. The base plate 220 comprises vise provisions 250 and workpiece support member(s) 260 which define a workpiece support territory 270 extending therebetween. As will be appreciated, the vise provisions 250 include a vise base 252 and a handle base 254. The base plate 220 further includes one or more pipe bender(s) 280 located within the territory 270. In FIG. 6, the workpiece support member(s) 260 are disposed along a lateral side region of the base plate 220 rather than being centrally located along a longitudinal axis of the base plate as depicted in FIGS. 1-4. Again, the workpiece support member(s) 260 can be oriented to face the vise base 252.

Figure 7:
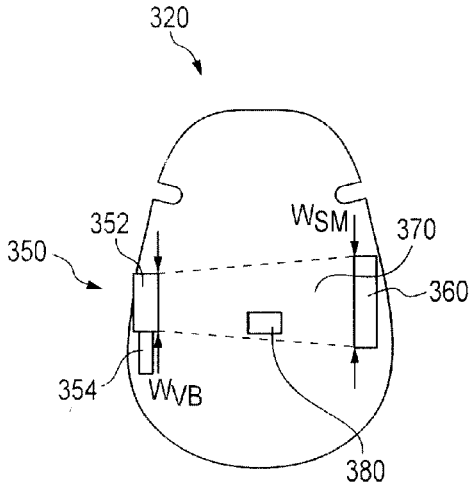
FIG. 7 is a schematic planar view of another preferred embodiment base plate in accordance with the present invention.

FIG. 7 illustrates yet another preferred embodiment base plate 320 in accordance with the present invention. The base plate 320 comprises vise provisions 350 and workpiece support members 360 that define a workpiece support territory 370 extending therebetween. The vise provisions 350 include a vise base 352 and a handle base 354. The base plate 320 also comprises one or more pipe bender(s) 380 that are disposed within the support territory 370. The base plate 320 of FIG. 7 features workpiece support members 360 and vise provisions 350 that are located along generally opposite lateral regions of the base plate 320. In this embodiment, the pipe benders 380 are generally centrally located between the vise provisions 350 and the workpiece support members 360.

Figure 8:
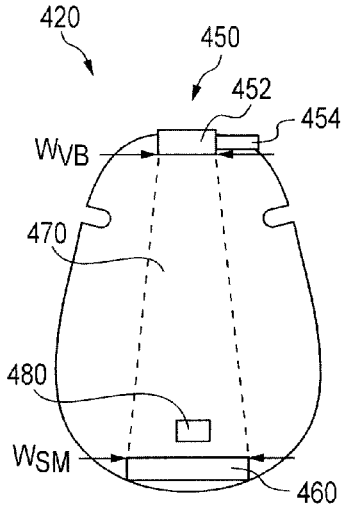
FIG. 8 is a schematic planar view of another preferred embodiment base plate in accordance with the present invention.

FIG. 8 depicts yet another preferred embodiment base plate 420 in accordance with the present invention. In this version of the invention, the base plate 420 comprises vise provisions 450 and workpiece support members 460 across from one another, yet located on opposite ends as compared to the base plate 20 described in conjunction with FIGS. 1-4. As will be appreciated, the vise provisions 450 include a vise base 452 and a handle base 454. The base plate 420 comprises one or more pipe bender(s) 480 located within a workpiece support territory 470 extending between the vise provisions 450 and the workpiece support member(s) 460.

It will be appreciated that the invention includes variations of all of the placement configurations depicted in FIGS. 5-8. Thus for example, referring to FIG. 5, the vise base 152 could be located along the right hand side of the base plate 120, instead of the left hand side as shown. Similarly, in FIG. 6, the vise base 252 could be disposed on the right hand side of the base plate 220 and the workpiece support member(s) 260 disposed on the left hand side of the base plate 220. Similar variations are contemplated for the configurations depicted in FIGS. 7 and 8.

Moreover, it will be understood that the invention is not limited in any respect concerning the orientation and/or location of a handle base such as 154 relative to a corresponding vise base 152. Referring to FIG. 5 for example, although the handle base is shown as extending from a particular region of the vice base 152, the invention includes alternate arrangements of handles relative to a corresponding vice base.

Figure 9:
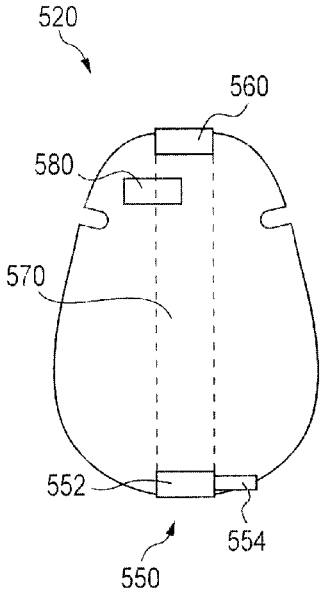
FIG. 9 is a schematic planar view of another preferred embodiment base plate in accordance with the present invention.

As previously noted, the one or more pipe bender(s) may be located entirely within or only partially within a workpiece support territory. Previously described FIGS. 1-8 illustrate various preferred embodiments of base plates in which their corresponding pipe benders are located entirely within a support territory. FIGS. 9-12 illustrate various preferred base plates in which their corresponding pipe benders are only partially located within a support territory. For example, FIG. 9 illustrates a preferred embodiment base plate 520 comprising vise provisions 550, workpiece support members 560, and a workpiece support territory 570 extending therebetween. The vise provisions 550 include a vise base 552 and a handle base 554. The base plate 520 further comprises one or more pipe bender(s) 580 partially located within the support territory 570. As a result of the pipe bender(s) 580 being partially located within the support territory 570, a portion of the pipe bender(s) 580 are located outside of the support territory.

Figure 10:
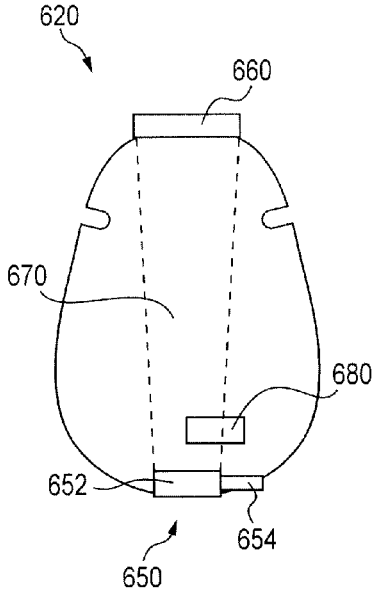
FIG. 10 is a schematic planar view of another preferred embodiment base plate in accordance with the present invention.

FIG. 10 illustrates yet another preferred embodiment base plate 620 comprising vise provisions 650, workpiece support members 660, and a workpiece support territory 670 extending therebetween. The vise provisions 650 include a vise base 652 and a handle base 654. The base plate 620 further comprises one or more pipe benders 680 which are partially located within the support territory 670. In this version, the benders 680 are located closer to the vise provisions 650 than the support members 660.

Figure 11:
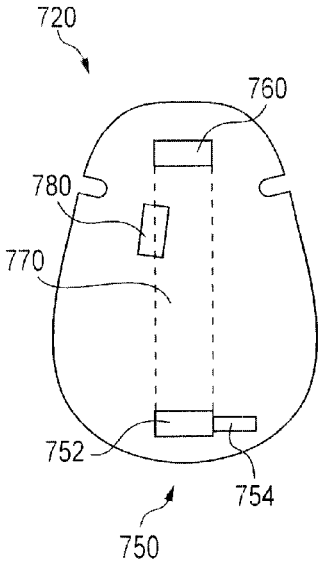
FIG. 11 is a schematic planar view of another preferred embodiment base plate in accordance with the present invention.

FIG. 11 illustrates yet another preferred embodiment base plate 720 in accordance with the present invention. The base plate 720 includes vise provisions 750, workpiece support members 760, and a workpiece support territory 770 extending therebetween. As will be understood, the vise provisions 750 include a vise base 752 and a handle base 754, spaced therefrom. The base plate 720 further includes one or more pipe bender(s) 780 at least partially disposed in the support territory 770. In this embodiment, it will be noted that one or both of the vise provisions 750 and the workpiece support members 760 can be located toward an interior region of the base plate 720 and spaced from the outer edge of the plate 720.

Figure 12:
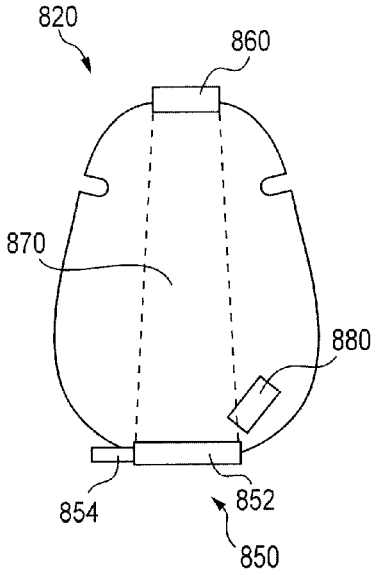
FIG. 12 is a schematic planar view of another preferred embodiment base plate in accordance with the present invention.

And, FIG. 12 illustrates yet another preferred embodiment base plate 820 in accordance with the present invention. The base plate 820 comprises vise provisions 850 and workpiece support members 860. The vise provisions 850 include a vise base 852 and a handle base 854. The base plate defines a workpiece support territory 870 extending between the vise provisions and the support members 860. In this embodiment, one or more pipe benders 880 are located only partially within the support territory. In this embodiment, the pipe benders 880 are located in a corner region of the plate 820 near the vise base 852.

The present invention also includes embodiments in which one or more benders are located or otherwise positioned so as to be spaced from the location of a leg along the underside of a base plate. Although several of the embodiments depicted in FIGS. 5-12 embody such a configuration, further description is provided as follows. In such a configuration, one or more benders are located in a region of the base plate which does not directly overlie a leg receptacle such as leg receptacle 28 depicted in FIG. 1. For example, it is contemplated that one or more benders could be located adjacent or next to an edge slot 32 as shown in FIGS. 1-2 and 4. Preferably, at least a portion of the bender (not overlying a leg receptacle) extends into a workpiece support territory as described herein. In these preferred configurations in which a bender does not overlie a leg receptacle, the bender is preferably aligned with a leg and/or leg receptacle disposed along an opposite region across the base plate.

In all of the embodiments described in conjunction with FIGS. 5-12, i.e. base plates 120, 220, 320, 420, 520, 620, 720, and 820, the base plates define a workpiece support territory, i.e. 170, 270, 370, 470, 570, 670, 770, and 870. As noted, each workpiece support territory extends between vise provisions and preferably a vise base of the vise provisions and a workpiece support member. As previously noted in conjunction with the description of FIGS. 1-4, the support territory can be in a wide array of different forms, shapes, and sizes. The widths of the territory at each end can be different from one another or can be the same. Thus, a support territory may correspond to any of conditions (i)-(iii):

$$W_{VB}=W_{SM}; \quad \text{(i)}$$

$$W_{VB}>W_{SM}; \quad \text{(ii)}$$

or $$W_{VB}<W_{SM}. \quad \text{(iii)}$$

The present invention also includes embodiments in which the base plate does not include a workpiece support member. Although such embodiments are less preferred than the embodiments described herein, the invention includes base plates free of such members such as 160, 260, 360, 460, 560, 660, 760, and 860. In these less preferred configurations, the workpiece support territory is defined by projecting the width of the vise provisions across the upwardly directed surface of the base plate. The lines of projection are generally taken parallel to the orientation of a member such as a pipe when secured in the vise provisions. Furthermore, it will be understood that the invention includes base plates having a wide array of vise types. In no way is the invention limited to base plates with chain vises. Non-limiting examples of vises include chain vises, yoke vises, machine or drill vises, compound slide vises, off-center vises, angle vises, sine vises, rotary vises, diemaker's vises, and pin vises.

Figure 22:
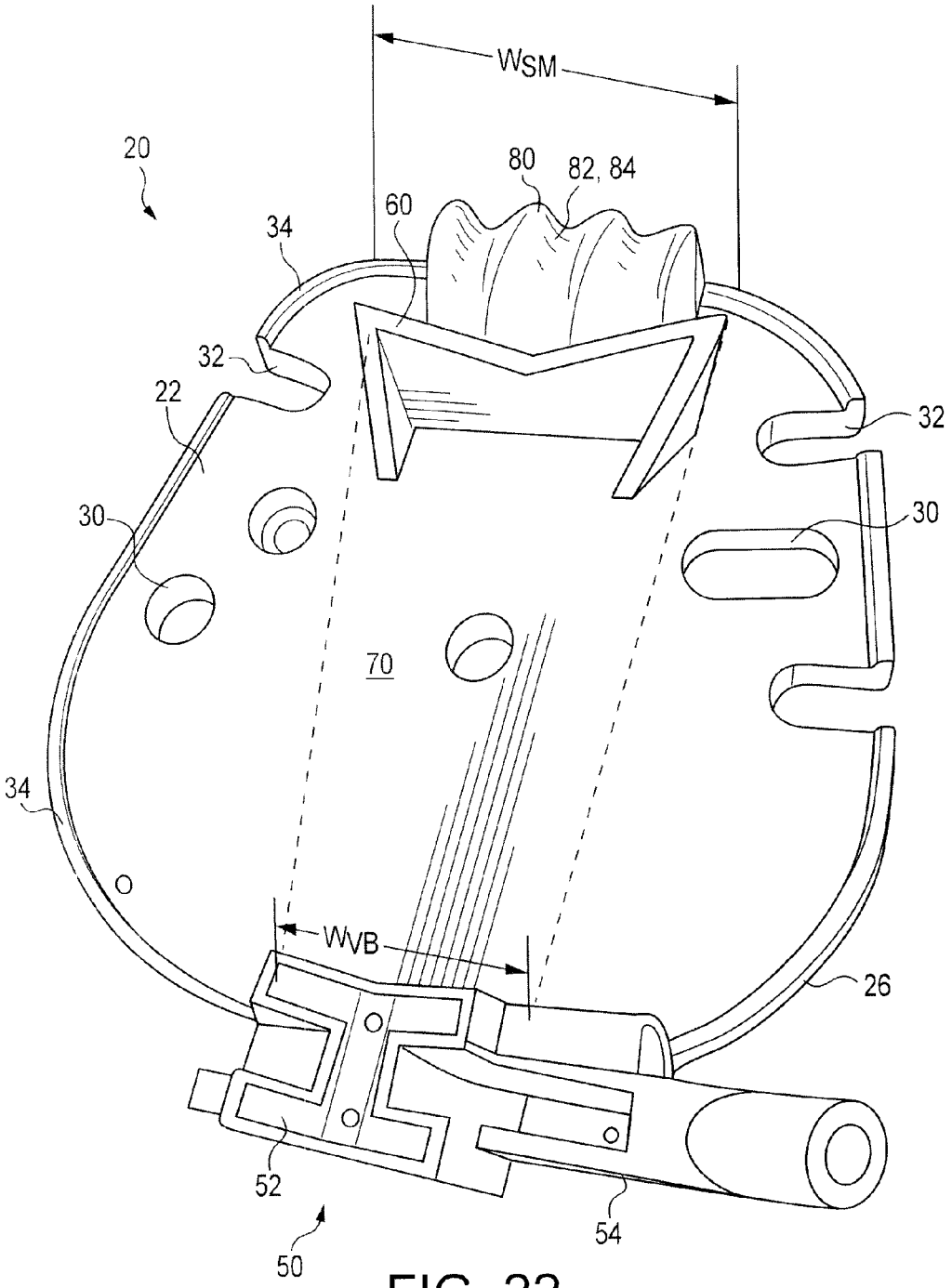
FIG. 22 is an illustration of an alternate configuration of another preferred base plate in accordance with the invention.

Furthermore, it is also contemplated that the present invention includes embodiments in which the workpiece support member is located or otherwise disposed between the benders and the vise provisions. In these alternate configurations, the benders are located along a peripheral edge region of the base plate with the workpiece support member disposed at least partially between the benders and the vise provisions. Thus, the workpiece support member is disposed inboard of the benders, or the benders are disposed outboard of the workpiece support member. FIG. 22 illustrates an example of such an alternate configuration of the embodiment described in conjunction with FIG. 2.

Figure 13:
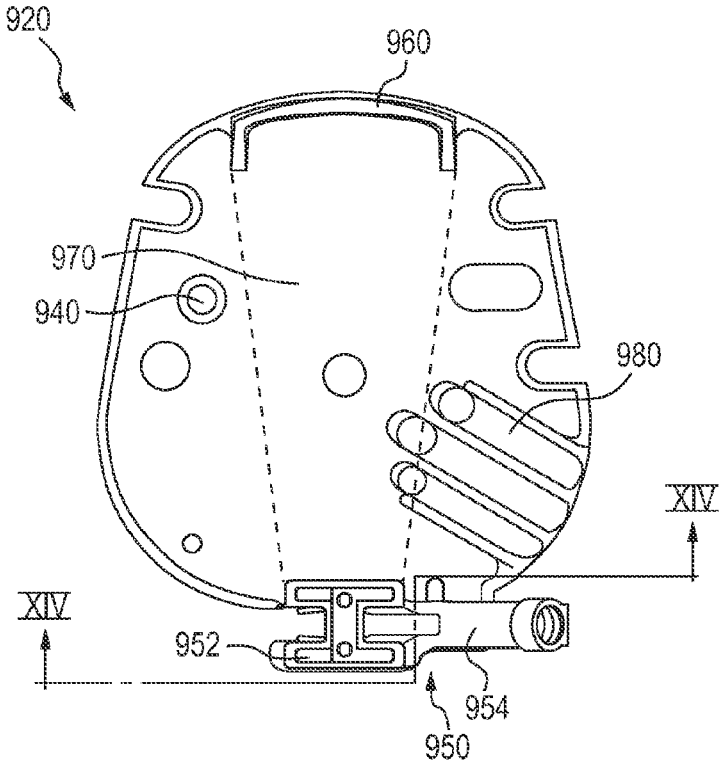
FIG. 13 is a schematic planar view of another preferred embodiment base plate in accordance with the present invention.
Figure 14:
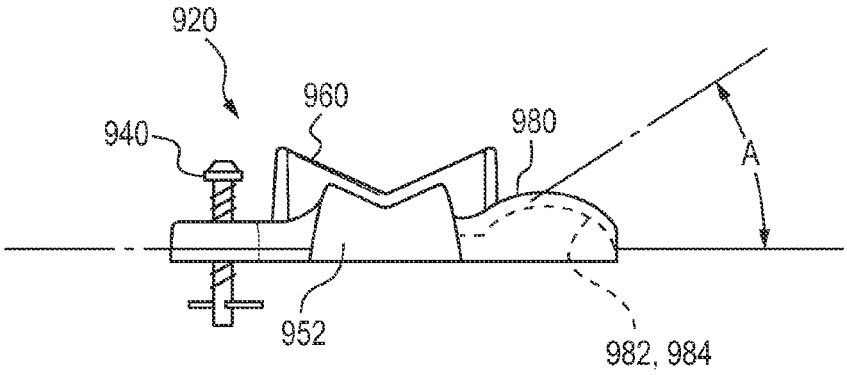
FIG. 14 is a schematic side view of the base plate illustrated in FIG. 13.

In certain embodiments, it may be preferred to provide pipe benders that extend upward from a work face of the base plate (as measured immediately adjacent to the work face of the base plate) at an angle that is less than 90°, for example from about 60° to about 30°, and most preferably about 45°. Such a configuration for the pipe benders may facilitate a bending operation since the portion of pipe extending upward from the base plate is then not directly above the base plate and so may be more accessible to an operator. Referring to FIGS. 13 and 14, another representative preferred base plate 920 is illustrated. The base plate 920 comprises a jackscrew 940 and vise provisions 950 including a vise base 952 and a handle base 954. Located generally opposite from the vise provisions 950 is one or more workpiece support members 960. As previously described herein, a workpiece support territory 970 is defined between the vise provisions 950 and the support members 960. The base plate 920 also comprises pipe benders 980 at least partially located within the support territory 970. The pipe benders 980 include upwardly directed bending mandrels 982 that define a recessed concave region 984. The forming or bending surface extends upward from the work face of the base plate 920 at an angle A, which is from about 60° to about 30°; and preferably about 45°. Angle A is taken between the work face of the base plate and a lowermost region of the bending surface of a mandrel, adjacent the work face. Although the invention is not limited to any particular location of the pipe benders so long as they are at least partially located within a workpiece support territory, it is preferred to position the pipe benders directly above the location along the underside of the base plate at which a leg is affixed or engaged.

In certain embodiments, it may be preferred to include one or more leveling provisions for the vise stands. Leveling provisions enable an operator to adjust the orientation of the base plate. Preferably, the leveling provisions are provided in association with at least one of the legs, and most preferably in association with one leg. It is also contemplated that leveling provisions could be included on each leg. As explained herein, it is most preferred that the leveling provisions enable an operator to adjust the orientation of the base plate while the stand is under a load, such as while supporting a workpiece and/or during application of a stabilizing load such as from a jackscrew.

A wide array of different assemblies and strategies can be used to enable leveling of the vise stands of the invention. For example, leveling provisions can be in the form of threaded leg members such that rotation of a leg member results in linear extension or retraction of the leg member generally along its longitudinal axis. Another form of leveling provisions is the use of threaded members disposed on the distal ends of the legs. The extent of adjustment of the leveling provisions is preferably such that the orientation of the base plate can be changed by about +/−3°. However, the invention includes versions in which the orientation can be changed to a greater extent such as by at least +/−5° of more.

The leveling provisions can include gross leveling adjustments and fine leveling adjustments. For example, gross adjustments can be in the form of telescoping leg sections engaged with one another by a member that is inserted into aligned apertures formed in the leg sections. A collection of apertures are preferably formed in each leg section. Upon appropriate positioning of one leg section to another to a desired leg length and alignment of a corresponding pair of apertures, the member is inserted into the aligned apertures thereby engaging the leg sections together.

Fine leveling provisions can be provided by threaded members disposed at the distal ends of the legs. Similarly, incorporating threaded regions along a length portion of a leg or leg section could also be used for fine leveling provisions or gross leveling provisions depending upon the thread characteristics and thread spacing.

Optional locking provisions can be included in association with the leveling provisions. Locking provisions can be in a wide variety of forms such as threadedly engaged locking members, locking nuts, and the like.

Figure 15:
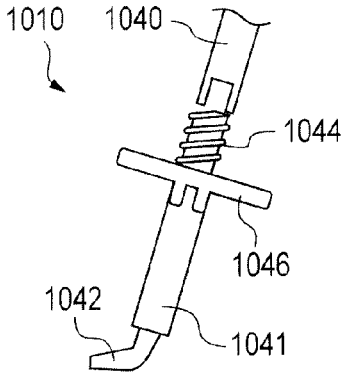
FIG. 15 is a schematic view of a portion of a leg of a vise stand including a preferred leveling provision in accordance with the present invention.

FIG. 15 schematically illustrates a preferred embodiment leveling provision 1010 provided in association with a leg 1040 of a vise stand, such as stand 10 depicted in FIG. 1 The leg 1040 defines a distal end 1042 and a proximal end (not shown) at which the leg 1040 is coupled or otherwise engaged to a base plate (not shown). The leveling provision 1010 is preferably located between the distal and proximal ends of the leg 1040 and in this version, include a first threaded member 1044 engaged to a proximal portion of the leg and a second correspondingly threaded member 1046 threadedly engaged therewith. The second threaded member 1046 is engaged to a distal portion of the leg 1040. As will be appreciated, upon rotation of the second member 1046, the distal end 1042 of the leg 1040 is linearly displaced along the longitudinal axis of the first threaded member 1044 and the leg 1040. Preferably, key provisions are provided in association with the distal end 1042 so that upon desired positioning of the distal end 1042, that end is precluded from rotating about the longitudinal axis of the leg 1040. In a preferred configuration, the threaded member 1046 engages a lower leg portion 1041 to capture the leg portion 1041 and attach the portion 1041 to the leg 1040.

Figure 16:
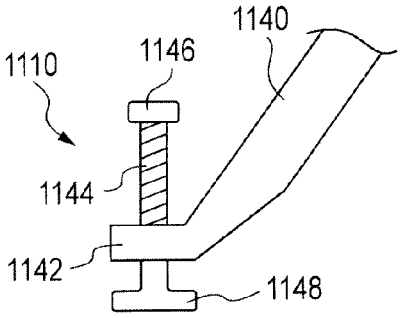
FIG. 16 is a schematic view of leg portion and another preferred leveling provision in accordance with the present invention.

FIG. 16 schematically depicts yet another embodiment of a leg leveling provision 1110 provided in association with a leg 1140. The leveling provision 1110 is preferably located proximate a distal end 1142 of the leg 1140. The provision 1110 includes a threaded member 1144 having a head 1146 adapted to be engaged with a wrench and an opposite foot 1148. The member 1144 extends through the distal end 1142 of the leg 1140 and is threadedly engaged therewith. As will be appreciated, upon rotation of the member 1144, the linear distance between the foot 1148 and the distal end 1142 of the leg 1140 can be adjusted.

Figure 17:
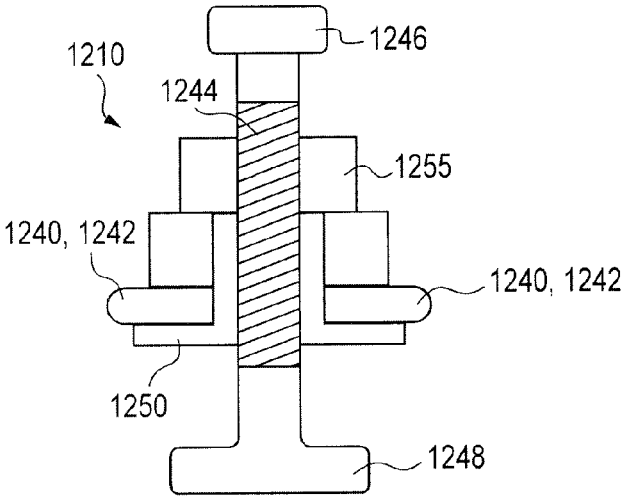
FIG. 17 is a detailed schematic view of a leg portion and another preferred leveling provision in accordance with the present invention.

FIG. 17 schematically depicts yet another leveling provision 1210 and its incorporation in a distal end 1242 of a leg 1240. The leveling provision 1210 includes a threaded member 1244 having a head 1246 and a foot 1248. A threaded foot insert 1250 is disposed within an aperture defined in the leg distal end 1242. Upon selectively rotating the member 1244 to a desired position relative to the distal end 1242 of the leg 1240, a locking nut 1255 can be used to secure the member 1244 in the desired position.

Figure 18:
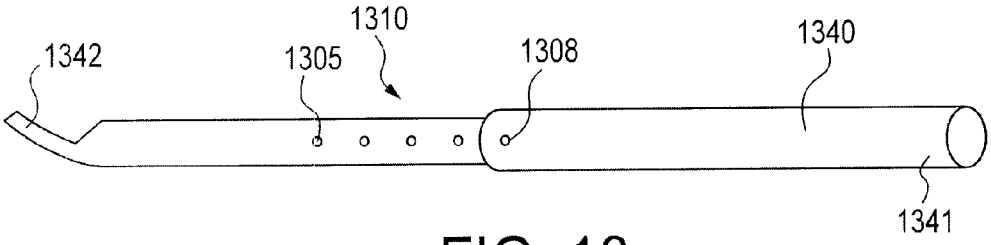
FIG. 18 is a schematic illustration of another preferred leveling provision in accordance with the present invention.

FIG. 18 schematically depicts another leveling provision 1310 provided in association with one or more legs 1340 of a vise stand (not shown). Each leg 1340 defines a proximal end 1341 and a distal end 1342. Leveling provision 1310 is provided between the ends 1341 and 1342. In this version, a plurality of apertures 1305 are defined along a portion of a distal leg section and at least one aperture 1308 is defined in a proximal leg section. The leg sections are preferably telescopically engageable with each other. Upon aligning the apertures 1305 and 1308 with one another, a retention member or pin (not shown) is inserted into the aligned apertures to thereby secure the leg sections together.

It will be appreciated that any of the described leveling provisions can be used in combination with other leveling provisions and used in more than one leg of the vise stands described herein. That is, in no way is the invention limited to any of the particular leveling provisions described herein.

Figure 19:
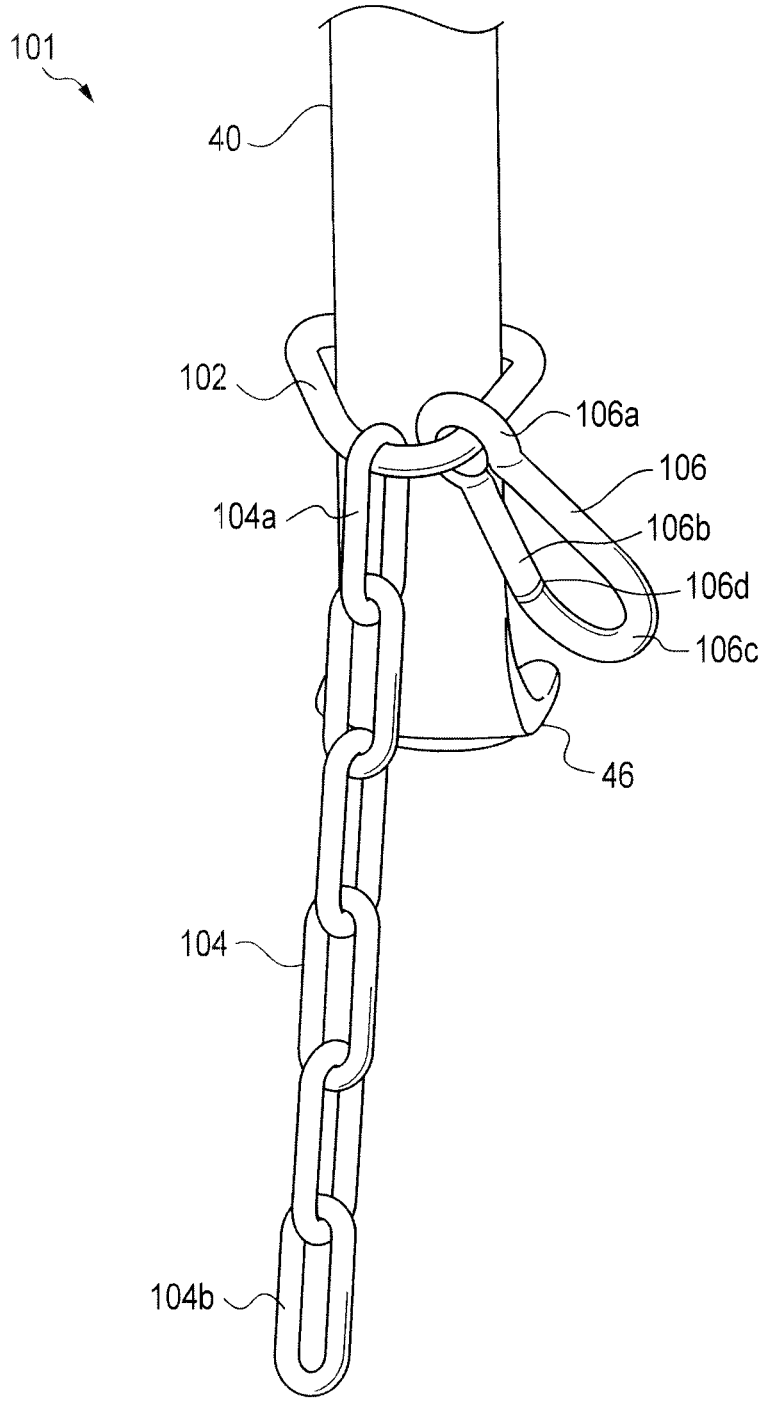
FIG. 19 is a detailed view of a preferred securing assembly used in the preferred stands of the invention.

FIG. 19 is a detailed view of a preferred embodiment securing assembly 101 provided in conjunction with the preferred embodiment stands. The securing assembly 101 generally comprises a first retention member 102, a section of chain 104 or other like member, and a clasp 106 having closure provisions. Preferably, the retention member 102 extends about and most preferably is affixed to a leg of a stand, such as for example the leg 40 of the stand 10 depicted in FIG. 1. The retention member 102 is preferably positioned near the distal end of the leg 40, such as the end 46, however the invention is not limited to such arrangements. Preferably, an end 104*a* of the chain 104 is attached to the retention member 102. The opposite end 104*b* is free. The clasp 106 preferably includes an engagement end 106*a* at which the clasp 106 is engaged with the retention member 102, and a relatively larger fastening region 106*c*. The clasp 106 preferably includes a connector member 106*b* that is releasably secured to the fastening region 106*c* along a connector interface 106*d*. Typically, and after positioning the stand (not shown) in a retracted position, the chain 104 is wrapped around the other legs (not shown). The free end 104*b* of the chain 104 is secured to the clasp 106 and preferably by disengaging the connector member 106*b* from the fastening region 106*c* at connector interface 106*d*.

As will be understood, either the connector member 106*b* or the fastening region 106*c* of the clasp 106 is inserted into the end link 104*b* of the chain 104. The connector member 106*b* is then engaged with the fastening region 106*c* to "close" the clasp 106 and thereby affix the end 104*b* of the chain 104 to the clasp 106. It will be appreciated that a wide variety of other fastening and retaining assemblies could be used for the clasp 106, and/or the chain 104. Non-limiting examples include cables, cords, ties, straps, and flexible members.

Figure 20:
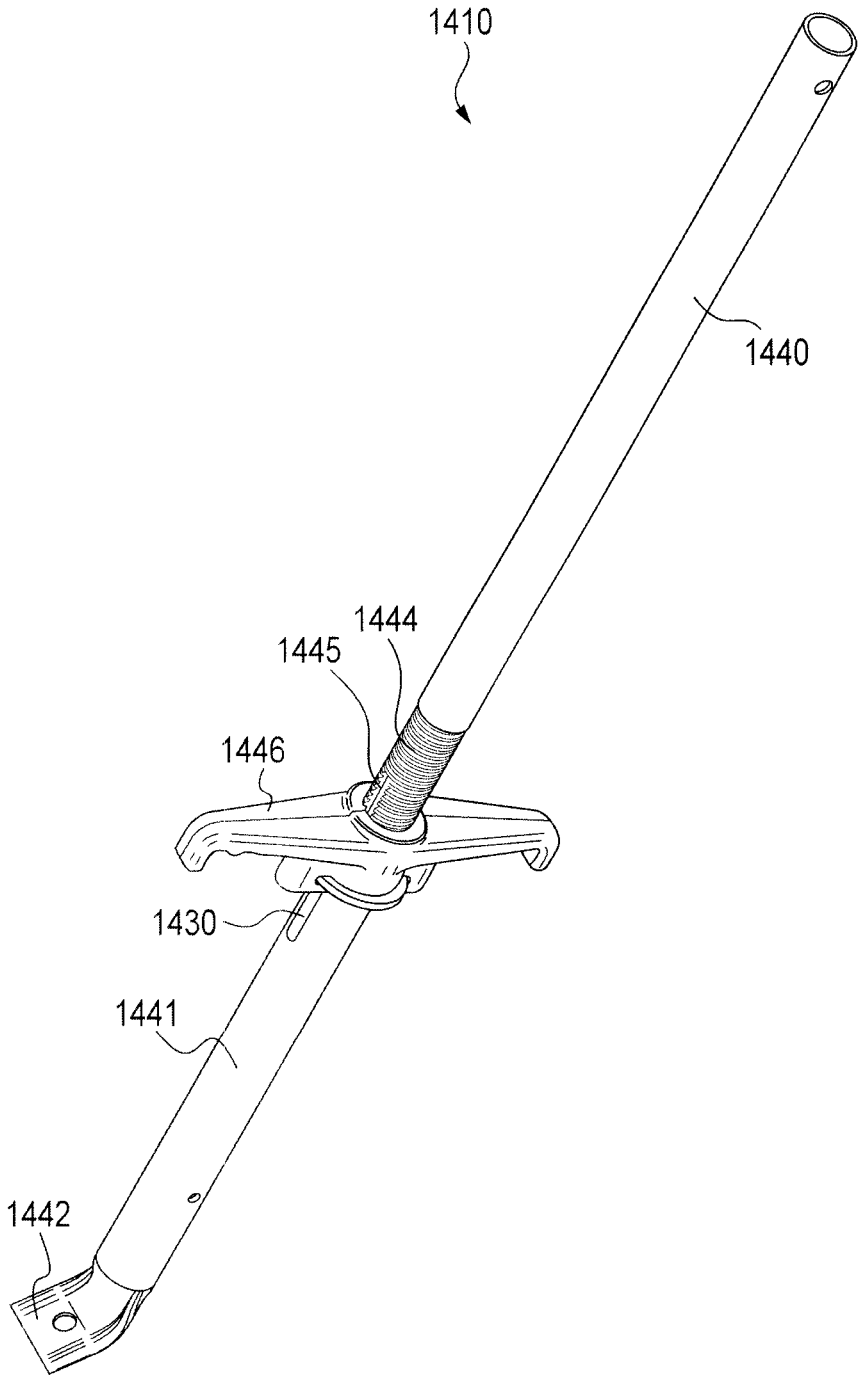
FIG. 20 is a perspective view of a preferred embodiment leg assembly used in the preferred pipe vise stands of the invention.
Figure 21:
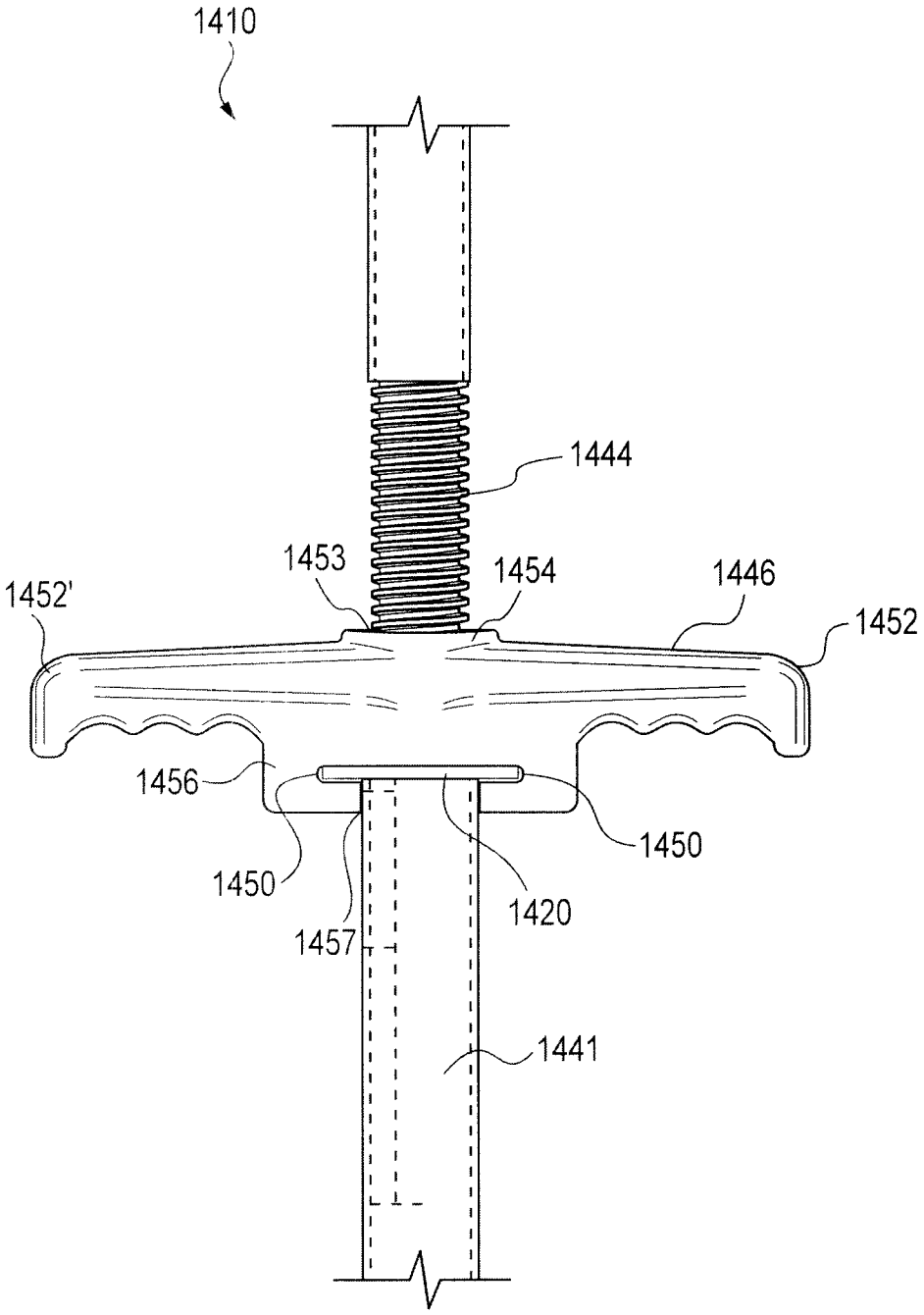
FIG. 21 is a detailed side view of an adjusting provision of the leg assembly illustrated in FIG. 20.

FIGS. 20 and 21 illustrate a preferred embodiment leg assembly 1410 used in the vise stands described herein. The leg assembly 1410 includes an upper leg portion 1440, a lower leg portion 1441 and adjusting provisions therebetween for coupling the two leg portions together and providing selectively adjustable positioning of the leg portions relative to one another. The lower leg portion 1441 defines a distal end or foot 1442 preferably integrally formed with the lower leg portion 1441. The adjusting provisions preferably include a member 1446 rotatably attached to the lower leg portion 1441. The member 1446 defines a central threaded bore which receives a threaded member 1444 or extension of the upper leg portion 1440. As will be appreciated, upon threadedly engaging the member 1446 and the member 1444 and rotating the member 1446, the linear distance between the upper and lower leg portions 1440 and 1441 can be selectively and incrementally varied.

Preferably, key provisions are provided in both the upper and lower leg portions. The key provisions prevent rotation of the lower leg portion 1441 about its longitudinal axis relative to the upper leg portion 1440, and vise-versa. Although a wide array of key provisions may be used, a preferred configuration is shown in FIG. 20. An inwardly extending slotted region 1430 is provided along an end of the lower leg portion 1441. A slotted depression or aperture 1445 is provided in the threaded member 1444. The slotted depression or aperture 1445 is sized to slidably receive the inwardly extending slotted region 1430. This configuration allows the leg portions 1441 and 1440 to be linearly displaced relative to one another along their longitudinal axes, yet prevents rotation of one relative to the other about the longitudinal axis.

FIG. 21 illustrates a preferred configuration and engagement between the components. The member 1446 defines a pair of laterally extending handles or grips 1452 and 1452' which extend in opposite directions from a central body 1456. The member 1446 defines a threaded bore extending through the body 1456 from a first opening 1454 to a second oppostively directed opening 1457. The second opening 1457 is sized to rotatably receive an end of the lower leg portion 1441. The end of the leg portion 1441 preferably includes an outwardly extending disk shaped member 1420. The member 1446 defines an interior hollow region 1450 accessible from the opening 1457. The hollow region 1450 is sized to rotatably receive the disk member 1420. Thus, by this configuration, the member 1446 can rotate relative to the lower leg portion 1441 and disk member 1420, yet the two leg components are securely coupled together.

The various components of the vise stands described herein can be formed from nearly any suitable material having sufficient strength, durability and rigidity for the stands to function as described herein. Metals such as various grades of hardened steel are preferred. Other metals such as alloys of aluminum, magnesium, and the like are also contemplated. A preferred material for the base plate is aluminum. It is further envisioned that composite materials could be used for certain components. The present invention is not limited to any particular type of material.

Representative examples of features, construction, assembly, materials, and other aspects of vise stands and pipe vise stands are provided in one or more of the following U.S. Pat. Nos. 1,634,837; 798,371; 1,216,610; 4,715,760; 1,686,023; 1,393,766; 1,126,544; 4,231,557; and 7,430,968. In addition, such information is also noted in US Patent Application Publication US 2007/0080268.

Many other benefits will no doubt become apparent from future application and development of this technology.

All patents, published applications, and articles noted herein are hereby incorporated by reference in their entirety.

It will be understood that any one or more feature or component of one embodiment described herein can be combined with one or more other features or components of another embodiment. Thus, the present invention includes any and all combinations of components or features of the embodiments described herein.

As described hereinabove, the present invention solves many problems associated with previous type devices. However, it will be appreciated that various changes in the details, materials and arrangements of parts, which have been herein described and illustrated in order to explain the nature of the invention, may be made by those skilled in the art without departing from the principle and scope of the invention, as expressed in the appended claims.

What is claimed is:

1. A pipe vise stand comprising:

a base plate defining a work face and including at least one support provision extending from the work face and vise provisions spaced from the at least one support provision, the base plate further defining a workpiece support territory along the work face and, the workpiece support territory defined between the at least one support provision and the vise provision;

a plurality of legs attached to the base plate;

wherein the base plate further includes at least one tube bender disposed entirely within the workpiece support territory.

2. The pipe vise stand of claim 1 wherein the at least one tube bender includes three tube mandrels.

3. The pipe vise stand of claim 2 wherein all three tube mandrels are disposed within the workpiece support territory.

4. The pipe vise stand of claim 1 wherein the at least one tube bender includes an aperture defined in the base plate and the aperture is located within the workpiece support territory.

5. The pipe vise stand of claim 1 wherein the maximum height of the at least one tube bender is less than the minimum height of the at least one support provision.

6. The pipe vise stand of claim 1 further comprising leveling provisions in association with at least one of the plurality of legs.

7. The pipe vise stand of claim 1 further comprising a securing assembly affixed to a leg of the stand, the securing assembly including a retention member extending around the leg, a chain section having an end attached to the retention member, and a clasp engaged with the retention member and having closure provisions enabling the clasp to be selectively engaged with the chain section.

8. A pipe vise stand comprising:

a base plate; and a plurality of extendable legs movably attached to the base plate, each leg defining a proximal end attached to the base plate and a distal end opposite from the proximal end;

the vise stand being positionable between (i) a work configuration in which the plurality of legs are extended from the base plate to an extended position and the distal ends of the legs generally reside within a common plane, and (ii) a transport configuration in which the legs are retracted from their extended position;

the base plate defining a work face, the work face being upwardly directed when the vise stand is in a work configuration and the distal ends of the legs are contacting a horizontal surface, the base plate including:

vise provisions at a first location along the base plate;

support provisions at a second location along the base plate generally opposite and spaced from the vise provisions; and at least one bending mandrel extending from the base plate;

wherein the base plate defines a workpiece support territory along the work face of the base plate, the workpiece support territory defined between the vise provisions and the support provisions, and the at least one bending mandrel is at least partially located within the workpiece support territory, and the at least one bending mandrel includes a total of three bending mandrels, and all three of the bending mandrels are located within the workpiece support territory.

9. The pipe vise stand of claim 8 wherein the at least one bending mandrel is entirely located within the workpiece support territory.

10. The pipe vise stand of claim 8 wherein the base plate further defines at least one aperture adjacent to the at least one bending mandrel, the aperture sized and configured to receive pipe or tubing bent by the bending mandrel.

11. The pipe vise stand of claim 10 wherein the at least one aperture is also at least partially located within the workpiece support territory.

12. The pipe vise stand of claim 10 wherein the at least one aperture is entirely located within the workpiece support territory.

13. The pipe vise stand of claim 8 wherein the vise provisions include a selectively adjustable chain vise.

14. The pipe vise stand of claim 8 further comprising:

a jackscrew adapted to selectively engage a stationary rigid member and upon extending the jackscrew against the member, a downwardly directed load is exerted upon the pipe vise stand, thereby increasing the stability of the stand.

15. The pipe vise stand of claim 8 wherein the maximum height of the at least one bending mandrel is less than the minimum height of the support provisions.

16. The pipe vise stand of claim 8 further comprising leveling provisions in association with at least one of the plurality of legs.

17. The pipe vise stand of claim 8 further comprising a securing assembly affixed to a leg of the stand, the securing assembly including a retention member extending around the leg, a chain section having an end attached to the retention member, and a clasp engaged with the retention member and having closure provisions enabling the clasp to be selectively engaged with the chain section.

18. A base plate for use with a pipe vise stand, the base plate defining a work face, an oppositely directed underside, and a peripheral edge region generally extending between the work face and the underside, the base plate comprising:

at least one support provision extending from the base plate beyond the work face, the at least one support provision defining a first width dimension;

vise provisions extending from the base plate, the vise provisions defining a second width dimension, the vise provisions spaced from the at least one support provision;

wherein the base plate further defines a workpiece support territory along the work face, the workpiece support territory defined between the first width and the second width;

the base plate further comprising a tube bender disposed within the work piece support territory, the maximum height of the tube bender is less than the minimum height of the at least one support provision.

19. The base plate of claim 18 wherein the tube bender includes provisions for bending pipes having at least two different diameters.

20. The base plate of claim 18 wherein the vise provisions include a chain vise.

21. The base plate of claim 18 wherein the at least one support provision defines an upwardly directed V-shaped recessed region.

* * * * *